US005750920A

United States Patent [19]

Redecker et al.

[11] Patent Number: 5,750,920

[45] Date of Patent: May 12, 1998

[54] GRANULATED, STABILIZED α-AND β-OCTOGEN

[75] Inventors: Klaus Redecker; Gunter Schreiner, both of Nuremberg; Wolfgang Spranger, Furth, all of Germany

[73] Assignee: Dynamit Nobel Aktiengesellschaft, Troisdorf, Germany

[21] Appl. No.: 496,056

[22] Filed: Mar. 16, 1990

Related U.S. Application Data

[63] Continuation of Ser. No. 294,899, Jan. 5, 1989, abandoned, which is a continuation of Ser. No. 50,158, Apr. 27, 1987, abandoned.

[30] Foreign Application Priority Data

Apr. 26, 1986 [DE] Germany ..... 36 14 173.9

[51] Int. Cl.[6] ..... C06B 45/22

[52] U.S. Cl. ..... 149/11; 149/92

[58] Field of Search ..... 149/11, 92

[56] References Cited

U.S. PATENT DOCUMENTS

| | | | |
|---|---|---|---|
| 4,097,317 | 6/1978 | Schnur | 149/92 |
| 4,350,542 | 9/1982 | Kincaid et al. | 149/11 |
| 4,357,185 | 11/1982 | Ringbloom | 149/11 |
| 4,376,083 | 3/1983 | Ulsteen | 149/11 |
| 4,425,170 | 1/1984 | Jones | 149/11 |
| 4,430,132 | 2/1984 | Painter | 149/11 |
| 4,445,434 | 5/1984 | Brede et al. | 102/206 |
| 4,554,031 | 11/1985 | Kerviel et al. | 149/19.3 |
| 4,699,741 | 10/1987 | Back et al. | 149/11 |
| 4,770,099 | 9/1988 | Brede et al. | 102/472 |
| 5,043,031 | 8/1991 | Redecker et al. | 149/19.1 |
| 5,230,841 | 7/1993 | Redecker et al. | 264/3.1 |
| 5,268,469 | 12/1993 | Lukasavage | 540/475 |

*Primary Examiner*—Edward A. Miller

*Attorney, Agent, or Firm*—Antonelli, Terry, Stout, & Kraus, LLP

[57] ABSTRACT

The current invention treats α-octogene which, with the aid of a new procedure, has been coated with synthetic materials in such a manner that it does not convert into β-octogene at room temperature The coating is done at temperatures between 30° and 60° C. from an aqueous slurry; this causes granulates to form which can be heated to temperatures of 100° C. without a rearrangement to β-octogene to occur; even a grain growth does not take place. The granulates according to the invention are pourable and can be easily dosaged. β-octogene can be coated in the same manner, particularly if it is coated as very fine grain of less than 50 μm according to the invention. Thus, the current invention includes also the particularly fine β-octogene, coated according to the current procedure, which shows the same properties as the required α-octogene.

4 Claims, No Drawings

GRANULATED, STABILIZED α-AND β-OCTOGEN

This application is a Continuation of application Ser. No. 294,899, filed Jan. 5, 1989, now abandoned, which is a Continuation of application Ser. No. 050,158, filed Apr. 27, 1987, now abandoned.

The subject of the present invention are a synthetic material coated α-octogene, a procedure for its production and a synthetic material coated β-octogene with a particularly fine grain produced by this method.

The explosive matter cyclotetramethylenetetranitramine, which is also known in the literature under the name of 1,3,5,7-tetranitro-1 3 5,7-tetrazacyclooctane, is generally called octogene or—in the anglo-saxon literature—HMX. Of this compound, four crystal modifications are known:

1. The generally used monoclonal β-form with a density of 1.90 g/cm$^3$. It is stable at room temperature; when heated to 102° to 104.5° C. it converts to the α-form.
2. The α-form crystallizes orthorhombically; it has a density of 1.82 g/cm$^3$ and is metastable: it changes to the β-form, particularly in the presence of certain solvents at increased temperature. When heated to temperatures above 160° to 164° C. it changes to the γ-form.
3. The γ-form is metastable in the temperature range of 160° to 164° C.; it crystallizes monoclonally and converts to the δ-form at temperatures above 164° C.
4. This δ-form crystallizes hexagonally and is stable in the temperature range between 164° C. and the melting point of the octogene (see Encyclopedia of Explosives and Related Items Patr. 2700, vol. 3, page C 606 (1966))

For many application purposes it is important to use the pure α- or pure β-form, the latter with an extremely fine grain if possible. As however, the α-modification is metastable, as shown above and could convert to the β-modification, the stabilization of the α-form encounters great difficulties. These result from the fact that in the presence of liquid media, in which α-octogene can dissolve in traces, a slow conversion into the β-modification takes place Such a conversion is promoted even more by the presence of crystals of the β-modification as impurity.

The fact that the α-octogene is more sensitive to friction and impact than the β-modification also results in greater difficulties for its stabilization.

It is already known to embed friction and impact sensitive explosive matters, such as cyclotrimethylenetrinitramine (hexogene) or octogene (as β-form) in synthetic materials in order to reduce their impact sensitivity. This is done by mixing an aqueous slurry of the explosive matter with a solution of polyolefins in toluol at temperatures between 75° and 80° C. in the presence of a dispersing agent, such as gelatine (see U.S. Pat. No. 3,138,501).

However, this procedure cannot be transferred to the coating of pure α-octogene crystals, as there is the danger that a change to the β-modification will take place due to the presence of the solvent. The temperatures usable for this procedure also speak against a transfer of this known procedure to the production of an α-octogene with a synthetic material coating.

Thus, there was the problem to coat α-octogenes with a synthetic material in such a manner that during the coating process it will not convert into the β-form and that the obtained coating is such that no conversion takes place in the course of time. In addition, the coating should have the effect that the octogene is less sensitive to impact and friction and is easily pourable.

There was the additional problem of finding a procedure for the production of an in such a way coated α-octogene which would permit working at the lowest possible temperatures and could be used with substances which have practically no solubility for α-octogene.

The procedure to be found should also make possible the coating of very finely grained octogene crystals, without causing a growing of the crystals. The coated granules should thus start from grain sizes which are below 50 μm, so that it would also be possible to coat β-octogene crystals with a very small grain size (under 50 μm) by the procedure to be found.

As a solution to this problem, a procedure for the coating of α-octogene with synthetic material was found in which an intimately moved aqueous slurry of finely crystallized α-octogene is mixed with a solution or emulsion or suspension of a thermoplastic polymer at temperatures between 25° and 60° C., whereby granulate formation is attained, the formed granulate is heated to 100° C. while stirring and distilling off of the solvent for the polymers and the granulate is subsequently separated off. With the aid of this procedure it is possible, for the first time, to obtain granulated, finely crystallized α-octogene which is stable at room temperature, the individual crystals of which have a coating of thermoplastic polymers. Such an α-octogene is stable under usual storage conditions without modification changes.

With the aid of this procedure it is also possible to coat a very finely grained β-octogene with an average grain size distribution below 50 μm in such a manner that the β-octogene in the obtained granulate also has the same grain size distribution and does not grow together into larger crystals. The production of such β-octogene granulates is possible, according to the invention, with the use of polyvinylacetal resins as thermoplatic polymer.

Both octogene modifications produced according to the current process are made passive, as compared to the non-coated products and have a lower friction and impact sensitivity than untreated octogene.

Shipment can take place without the addition of water. Thus it is possible, for the first time, to ship even α-octogene in a waterfree condition.

The share of β-octogene in the α-octogene coated according to the invention is less than 0.3% by weight. The determination of the β-octogene content in the α-form is based on the quantitative evaluation of the main bands of the β-octogene at $\measuredangle\delta$=10.3° with the aid of x-ray diffraction. The evaluation is done by means of a calibration line; the latter was established by samples which were obtained by the mixing of defined amounts of β-octogene to pure α-octogene. The determination limit of β-octogene in this testing process is at about 0.3% by weight.

The coating of α-octogene according to the invention shows, in addition to the already cited advantages with regard to retention of purity and reduction of sensitivity, the additional advantage that in this manner a baking together of α-octogene is prevented. α-octogene generally is a very fine powder which can bake together solidly due to sedimentation during transport in an aqueous medium. The separation into the desired very fine particles after drying was so far only possible with increased safety risks. The fine powder obtained after separation was dusty in its dry state and difficult to dosage. The granulate obtained by means of the present invention eliminates these disadvantages; it remains loose and pourable under the usual storage conditions and is easy to dosage. The β-octogen obtained according to the new procedure also shows the same good properties as the α-octogene. These properties prove particularly favorable with very finely grained β-octogene with grain sizes below 50 μm. Such a fine-grained β-octogene tends to crystal growth in the presence of so-far known transport media. The β-octogene coated according to the invention retains its once assumed grain size; no crystal growth occurs.

Thermoplastic polymers that can be used for the coating are those which do not form aggressive gases during combustion. According to the invention this includes polyvinylacetal resins obtained by mixing polyvinyl alcohol with aldehydes as well as acrylic resins. The aldehydes which can be used for the preparation of the polyvinylacetal resins may have 1 to 6 carbon atoms. The preferred aldehyde is butyraldehyde, so that the preferrably used polyvinylacetal resins are the polyvinylbutyral resins, which may contain if necessary, up to 35% of a softener.

The usable acrylic resins include the actually known methylacrylate, methylmethacrylate and acrylnitril resins. However, it is also possible to use other resins on the basis of bifunctional monomers which suffer, after the mixing with the octogene, a radically triggered cross-linking or condensation.

In addition to the cited polymers, the coating substance may also contain a polymer which makes a contribution to the oxygen value and the explosion heat of the octogene or the propellant mixture produceable from it. Polynitropolyphenyles as described in DE-OS 27 52 166 may be named as examples for such polymers.

The amount of polymers to be used depends on its effect on the impact and friction sensitivity of the octogene mentioned above. In general, the necessary amounts are between 3 and 30% by weight, relative to the octogene. The preferred range is between 3 and 15% by weight.

The polymer is preferrably used in a solvent which has no solubility for octogene. Preferred solvents are alcohols, glycolether, ester, ketones or chlorinated hydrocarbons.

In the cited solvents, the polymers can also be used as dispersion or emulsion.

The production of the coatings is done in such a way that the octogene is suspended in water. The suspension is stirred and heated to a temperature of between 25° and 60° C. Within this temperature range the polymer is added as solution or suspension or emulsion, which causes granulate formation. Afther the granulate formation has taken place, an adhesive, such as dextrin or gum arabic, can be added to firm up the granulate. Subsequently, the dispersion is heated to temperatures up to 100° C. in order to distil off the solvent. During this time the stirring of the granulate is continued, so that it moves slightly in the water. After the completion of the distillation of the solvent, the separation of the granulate is done in a known manner, such as by filtration.

EXAMPLE 1

In a 3-l-beaker 93 g of α-octogene are prepared with 1.2 l of water. While stirring (approx. 500 rpm) it is heated to 50° C. Into this preparation a prepared solution of 7 g polyvinyl-n-butyral, dissolved in 250 ml ethylacetate is made to flow in within 5 minutes. After the granulate formation, a glue solution of 1.5 g gum arabic, dissolved in 100 ml of hot water, was added.

The stirring speed is reduced to about 300 rpm. the mixture heated to 70° C. After reaching 70° C., the stirring speed is greatly increased for about 5 to 6 minutes. For the distillation, the temperature is slowly increased to 95° to 98° C. During this, the rotation speed is decreases such that the granulate can be slightly moved in the water.

After the distillation, the granulate is washed in water and separated by filtration. The granulate drying is done at 60° C. for 3 hours and then at 90° C. for 6 hours. The technical safety characteristics (according to BAM) are:

impact sensitivity 8 J friction sensitivity 360N pin charge no explosion.

EXAMPLE 2

In a 3-l-beaker 190 g α-octogene are prepared in 0.7 l water While stirring (approx. 700 rpm) it is heated to 30° C. Into this preparation, a prepared solution of 14.3 g polyvinyl-n-butyral, dissolved in 60 ml spirit of wine and 300 ml methylene chloride is made to flow in within 5 minutes under increasing stirring speed. After granulation, a glue solution of 1.5 g gum arabic, dissolved in 100 ml hot water, is added. The stirring speed is reduced to about 400 rpm.

For distillation, the temperature is slowly increased to 50° C. The rotation is reduced such that the granulate can be slightly moved in the water. After completed distillation, the granulate is washed in water and separated by filtration. The granulate drying is done at 60° C. for 3 hours and then at 90° C. for 6 hours. The technical safety characteristics (according to BAM) are:

impact sensitivity 8 J friction sensitivity 360N pin charge no explosion.

EXAMPLE 3

In a 3-l-beaker 172 g α-HMX and 12 g polynitrolpolyphenylene are prepared in 1.2 l water. While stirring (approx. 300 rpm) it is heated to 30° C.

Into this preparation, a prepared solution of 16 g polyvinyl-n-butyral, dissolved in 30 ml spirit of wine and 270 ml methylene chloride is made to flow in within 5 minutes under increasing stirring speed, which causes granulate formation, After granulation, a glue solution of 1.5 g gum arabic, dissolved in 100 ml hot water, is added. The stirring speed is increased to about 400 rpm.

For distillation, the temperature is slowly increased to 50° C. The rotation is reduced such that the granulate can be slightly moved in the water.

After completed distillation, the granulate is washed in water and separated by filtration. The granulate drying is done at 60° C. for 3 hours and then at 90° C. for 6 hours. The technical safety characteristics (according to BAM) are:

impact sensitivity 20 J friction sensitivity 360N pin charge produced brown coloration.

EXAMPLE 4

In a 3-l-beaker 172 g β-octogene with medium grain size of 8 μm are prepared in 0.7 l water. While stirring (approx. 500 rpm) it is heated to 30° C. A prepared solution of 16 g polyvinyl-n-butyral, dissolved in 30 ml spirit of wine and 200 ml methylene chloride is made to flow in within 5 minutes under increasing stirring speed. The processing of the reaction product is done as described in the previous examples. The technical safety characteristics (according to BAM) are:

impact sensitivity 10 J friction sensitivity 360N pin charge resulted in brown coloration.

We claim:

1. Granulated fine-grain stable α-octogen exhibiting reduced impact sensitivity, which comprises crystals of α-octogen covered with a coating of thermoplastic polymer;

said crystals of α-octogen containing less than 0.3% by weight of β-octogen.

2. Granulated α-octogen according to claim 1, wherein the coating of thermoplastic polymer further contains polynitropenylene.

3. Granulated α-octogen according to claim 1, wherein the coating of thermoplastic polymer comprises 3 to 15% by weight of the coated crystals.

4. Granulated α-octogen according to claim 1, produced by mixing an intimately stirred aqueous slurry of finely crystallized α-octogen with a solution or emulsion or suspension of a thermoplastic polymer at a temperature of between 25° and 60° C. while forming granules of the α-octogen coated with the polymer, heating of the granulate formed while stirring to temperatures up to the maximum of 100° C. while distilling a solvent for the polymer and subsequently separating of the granulate.

* * * * *